US008308264B2

(12) United States Patent
Sussmeier et al.

(10) Patent No.: US 8,308,264 B2
(45) Date of Patent: Nov. 13, 2012

(54) PRINTING ASSEMBLY CALIBRATION

(75) Inventors: John W. Sussmeier, Cold Spring, NY (US); Mark H. Macleod, New Milford, CT (US); John R. Masotta, Bethel, CT (US)

(73) Assignee: Pitney Bowes Inc., Stamford, CT (US)

( * ) Notice: Subject to any disclaimer, the term of this patent is extended or adjusted under 35 U.S.C. 154(b) by 499 days.

(21) Appl. No.: 12/650,918

(22) Filed: Dec. 31, 2009

(65) Prior Publication Data

US 2011/0128318 A1 Jun. 2, 2011

Related U.S. Application Data

(60) Provisional application No. 61/266,054, filed on Dec. 2, 2009.

(51) Int. Cl.
*B41J 29/38* (2006.01)
*B41J 29/393* (2006.01)
*B41J 2/015* (2006.01)

(52) U.S. Cl. ..... 347/16; 347/19; 347/20

(58) Field of Classification Search ..... 347/16
See application file for complete search history.

(56) References Cited

U.S. PATENT DOCUMENTS

2006/0216409 A1* 9/2006 Mishima ..... 427/66
* cited by examiner

*Primary Examiner* — Uyen Chau N Le
*Assistant Examiner* — Kajli Prince
(74) *Attorney, Agent, or Firm* — Brian A. Collins; Charles R. Malandra, Jr.; Steven J. Shapiro

(57) ABSTRACT

A printing assembly includes a transport system configured to transport items on a transport path and a printer rotatably disposed on a support. The printer includes a plurality of printing elements disposed sequentially along the transport path. A method of calibrating the printing assembly includes aligning a first reference associated with the printer with a second reference associated with the support, transporting an item on the transport path, printing a pattern on the item using a first printing element and a second printing element, determining a correction value from the pattern, and rotating the printer relative to the support in an amount corresponding to the correction value to substantially align the printing elements with the transport path.

19 Claims, 5 Drawing Sheets

PRINTING ASSEMBLY CALIBRATION

CROSS REFERENCE TO RELATED APPLICATIONS

The benefit of priority is claimed under 35 U.S.C. 119(e) of U.S. Provisional Patent Application No. 61/266,054 filed Dec. 2, 2009, entitled "Method and Apparatus to Calibrate a Multi-Pen Printer," which is incorporated by reference herein in its entirety.

FIELD OF THE INVENTION

The present invention relates to a printing assembly and, more particularly, to a method and device for calibrating a printing assembly.

BACKGROUND OF THE INVENTION

Item handling systems, such as mailpiece handling systems, for example, are known in the art. These systems include inserter systems, which create mailpieces and prepare them for mailing, as well as sorter systems, which sort completed mailpieces and direct the mailpieces to storage bins. Other types of item handling systems and related applications are known.

Inserter machines are used to create mailpieces for many different applications. Inserters contain a generally modular array of components to carry out the various processes associated with mailpiece creation. The processes include preparing documents, assembling the documents associated with a given mailpiece, adding any designated inserts, stuffing the assembly into an envelope, and printing information on the envelope.

Some inserter applications utilize ink jet printers to print the information, such as address information, advertisements, and/or a postal indicia, for example, on the face of the envelopes being processed. In those applications, which involve ink jet printing on a moving envelope, the alignment of the print heads may affect the image quality. Accordingly, it is desirable to calibrate the printers at certain intervals.

The calibration is presently accomplished by introducing a blank piece of paper (or a mailpiece) onto the vacuum belt transport that is in motion in the paper path direction. When the paper translates under the print heads, all four print heads print a test pattern on the paper. This test pattern consists of parallel lines in the paper path direction, printed by nozzles on each print head that are the same lateral distance from the edge of each respective print head and that have the same lateral spacing.

In conventional calibration methods, the printer is rotated such that sets of four printed lines, each generated by each pen, eventually fall directly on top of one another. However, to get all the lines to fall on top of one another is presently accomplished by a trial and error method. After the first test pattern is printed and a rotation adjustment is made, another test pattern is printed on another piece of paper followed by another rotation adjustment.

It is common to iterate this procedure ten or more times before the adjustment is declared close enough by one who is skilled with the procedure. This calibration procedure can take on the order of a half-hour to complete. The inefficiencies associated with the conventional procedure result in production mail down time, particularly when the procedure is carried out at frequent intervals, such as each time the print heads are replaced.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with the purpose of the invention, as embodied and broadly described herein, one aspect of the invention relates to a method of calibrating a printing assembly. In one embodiment, the printing assembly comprises a transport system configured to transport items on a transport path and a printer rotatably disposed on a support. The printer may comprise a plurality of printing elements disposed sequentially along the transport path.

According to one embodiment, the method comprises aligning a first reference associated with the printer with a second reference associated with the support, transporting an item on the transport path, printing a pattern on the item using a first printing element and a second printing element, determining a correction value from the pattern, and rotating the printer relative to the support in an amount corresponding to the correction value to substantially align the printing elements with the transport path.

As used herein, "items" include papers, documents, postcards, envelopes, brochures, enclosures, booklets, magazines, media items, including CDs, DVDs, computer disks, and/or other digital storage media, and packages having a range of sizes and materials.

In another aspect, the invention relates to a printing assembly, comprising a transport system configured to transport items on a transport path, a printer rotatably disposed on a support, and a controller. The printer may comprise a plurality of printing elements disposed sequentially along the transport path.

In one embodiment, the controller is configured to control an actuator to rotate the printer to align a first reference associated with the printer with a second reference associated with the support. The first reference may comprise one of a main scale and a vernier scale and the second reference may comprise the other of the main scale and the vernier scale.

As is known in the art, a vernier scale comprises a movable, auxiliary, graduated scale attached parallel to a main graduated scale. The vernier scale is calibrated to indicate fractional parts of the subdivisions of the main scale and is used to increase accuracy in measurement. Moreover, the vernier scale is typically constructed so that when its zero point is coincident with the zero point of the main scale, its graduations are at a slightly smaller spacing than those on the main scale, so none but the last graduation coincide with any graduations on the main scale. The vernier scale makes it possible to read a main scale much closer than one division of that scale.

The controller may be further configured to control the transport system to transport an item on the transport path, control the printer to print a pattern on the item using a first printing element and a second printing element, control a scanner to scan the pattern and send the pattern to a processing device for determination of a correction value from the pattern, and control the actuator to rotate the printer relative to the support in an amount corresponding to the correction value to substantially align the printing elements with the transport path.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Embodiments of the printing assembly calibration method and device according the invention will be described with reference to certain applications in mailpiece inserter systems. It should be understood, however, that embodiments of the invention may be used in association with other item handling systems configured to handle and transport mailpieces and other items.

Figure 1:
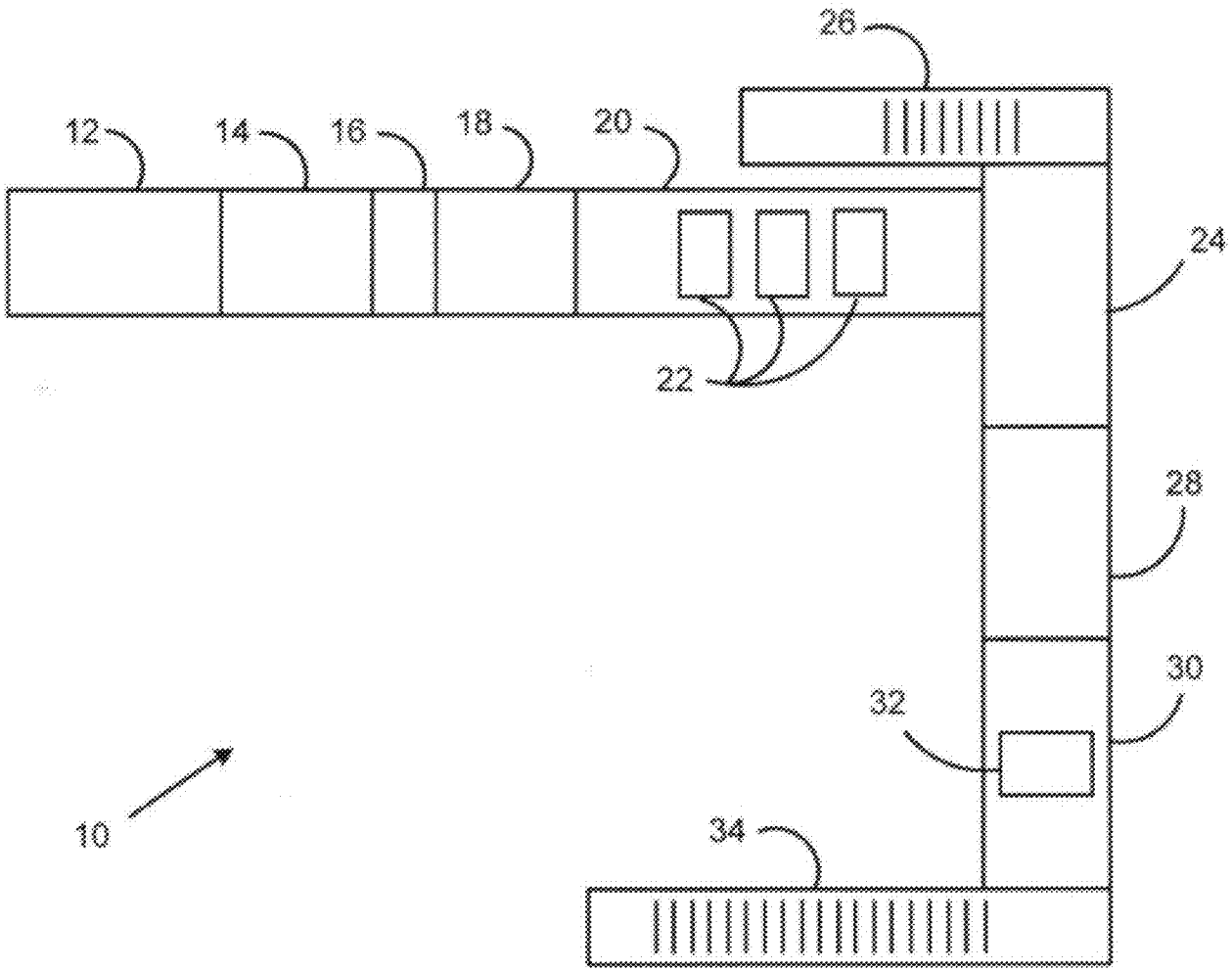
FIG. 1 is a schematic view of an item handling system utilizing an embodiment of the printing assembly of the present invention.

A schematic view of an item handling system (e.g., inserter system) 10 incorporating elements of the invention is shown in FIG. 1. The illustrated exemplary inserter system 10 comprises a document feeder 12, which provides pre-printed documents for processing. The documents, which may comprise bills or financial statements, for example, may be provided by the document feeder 12 as individual "cut sheets," or may be cut from a spool using a web cutter (not shown).

The documents next move to an accumulator 14 and a folder 16, where the documents for respective mailpieces are assembled and folded, respectively. The folded accumulations next move to a buffer 18, which holds the accumulations for sequential processing. The accumulations next move to a chassis 20. As each accumulation moves through the chassis, inserts from a plurality of feeder modules 22 are added to the accumulation.

The accumulations next enter an insertion area 24, where the finished accumulations are stuffed into envelopes provided by an envelope hopper 26, and the envelopes are sealed. The stuffed, sealed envelopes then enter an outsort module 28, for optionally diverting defective envelopes from the production stream. Defective envelopes may have accumulations that are improperly assembled and/or may be improperly sealed, for example.

The properly assembled and sealed envelopes next enter a metering and printing area 30, where markings, such as a postage indicia and/or address information, for example, are applied at a printing assembly 32 to form completed mailpieces. Finally, the completed mailpieces are deposited on a conveyor 34. Other systems utilizing more or fewer components and/or different arrangements of components may also be used.

Calibration of the printer, such as an inkjet printer, for example, is required to compensate for manufacturing tolerances of the print head locations with respect to the transport direction of the item transport system, as well as manufacturing tolerances from print head to print head. In one example, a printer manufacturer has indicated that such tolerances may result in deviations of print head alignment of up to approximately +/−0.40 degrees with respect to an item transport direction. Methods according to the invention may be applied to systems having different manufacturing tolerances.

Calibration is typically carried out during printer installation and may be required when the removable print heads are replaced. Replacement of the print heads may be required when they fail or have reached the end of their useful life, as indicated by poor print quality. The calibration method and device according to the invention, embodiments of which are described below with reference to the printing assembly 32, may provide quick and accurate calibration of the printing assembly 32 resulting in shorter down times and higher print quality.

Figure 2:
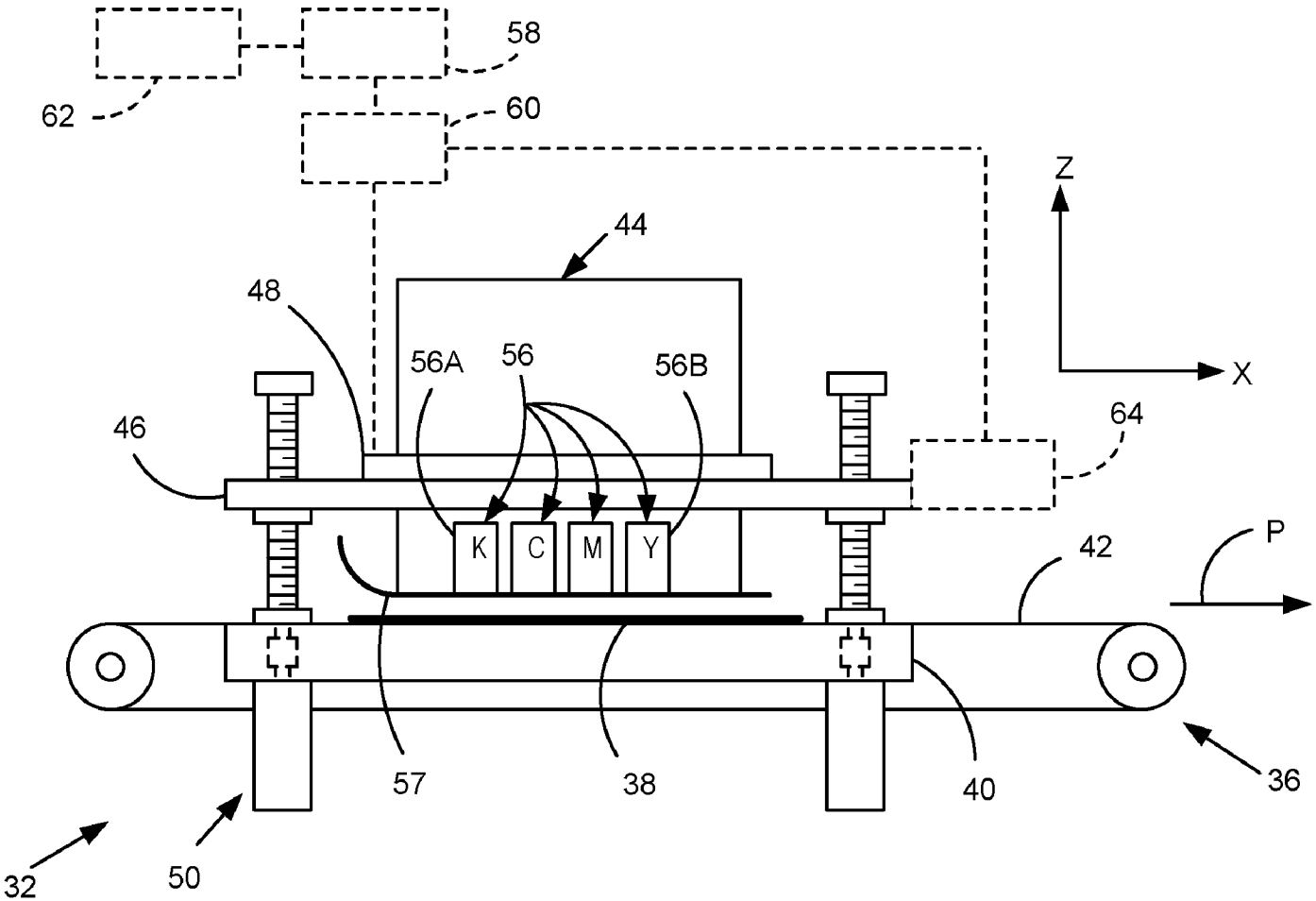
FIG. 2 is a partially schematic elevation view of the printing assembly of FIG. 1.
Figure 3:
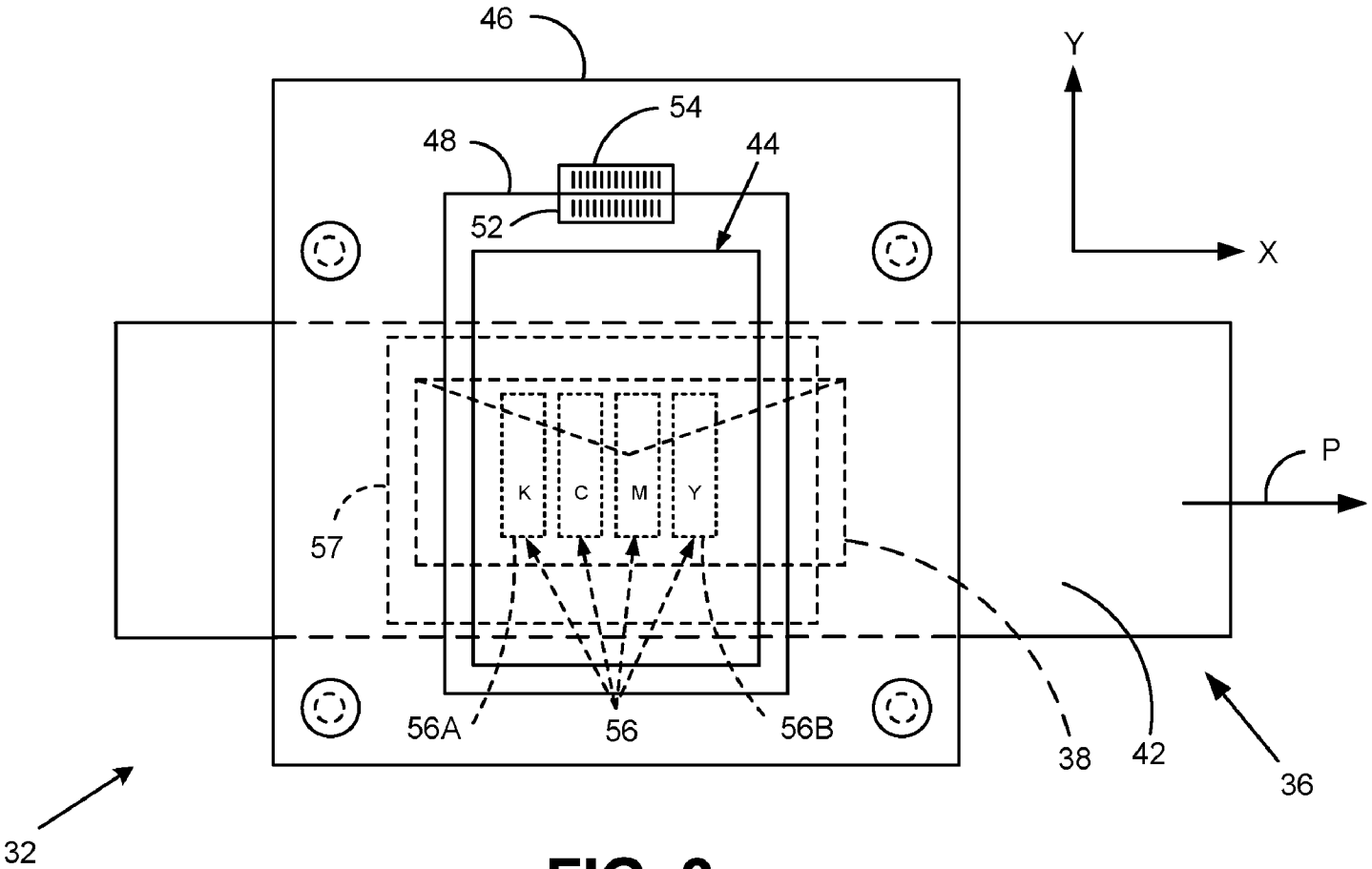
FIG. 3 is a partially schematic plan view of the printing assembly of FIG. 1.

An embodiment of a printing assembly 32 used with the item handling system 10 is shown in FIGS. 2 and 3. As shown, the printing assembly 32 comprises a transport system 36 configured to transport items 38 on a transport path P. In the illustrated embodiment, the transport system 36 comprises a base 40 and a transport element 42 disposed on the base 40 configured to transport the items 38. In one embodiment, the transport element 42 comprises a vacuum belt. Other transport elements may also be used. Items 38 are transported on the transport element 42 with a printed portion in the face-up orientation, which is the +Z-direction in FIG. 2.

The printing assembly 32 further comprises a printer 44 rotatably disposed on a support 46. In the illustrated embodiment, the printer 44 is disposed on a mounting plate 48, which is rotatably disposed on the support 46. As shown, the support 46 is coupled through an adjustment mechanism 50 to the base 40 below that supports the transport element 42. Mechanical features (not shown) in both the support 46 and the mounting plate 48 provide a fixed center of rotation for the mounting plate 48 relative to the support 46, which is generally located within the confines of the printer 44. In one embodiment, the support 46 receives a substantially circular fitting in which the mounting plate 48 rotates. Other rotating coupling arrangements may also be used.

As shown in FIG. 3, the printing assembly 32 is provided with a first reference 52 associated with the printer 44 and a second reference 54 associated with the support 46. As shown, the first reference 52 associated with the printer 44 is disposed on the mounting plate 48. The first reference 52 comprises one of a main scale and a vernier scale and the second reference 54 comprises the other of the main scale and the vernier scale. In one embodiment, the vernier scale is mounted on the mounting plate 48 and the main scale is mounted on the support 46. Other arrangements may also be used.

Figure 5:
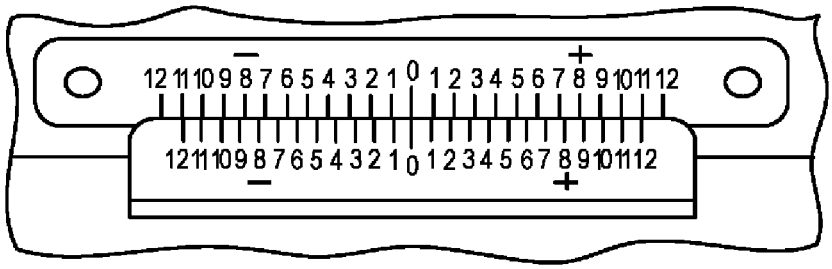
FIG. 5 is an embodiment of a main scale and a vernier scale used with the calibration method of the invention.

It has been determined that a range of +/−12 units on the vernier, corresponding to a rotation angle about the Z-axis of approximately +/−0.40 degrees off of nominal, is sufficient to accommodate the manufacturing tolerances identified above. An embodiment of the main scale and the vernier scale are shown in FIG. 5. The sizes of the units on the main scale and the vernier scale are a function of the distance from the center of rotation to the line where the scales meet and the desired amount of motion of the print heads associated with an adjustment of the vernier scale.

In the illustrated embodiment, the printer 44 comprises a plurality of printing elements 56 disposed sequentially along the transport path P. For example, the illustrated printer contains four different color print heads: K (black), C (cyan), M (magenta), and Y (yellow). Color print images are created by each print head 56 successively firing ink drops down to the moving item 38 (e.g., mailpiece) at the appropriate time (K first, Y last). A crash plate 57 protects the printing elements 56 from impacts with the items 38 being transported.

In another embodiment, the printing assembly 32 further comprises a controller 58 operatively connected to an actuator 60 and a processing device 62. The actuator 60 may comprise a servo motor, for example, or other actuator. The actuator 60 is configured to rotate the printer 44 relative to the support 46. In one embodiment, the actuator 60 is operatively connected to the mounting plate 48. The printing assembly 32 may further comprise a scanner 64. The operation of those components is described below.

In one embodiment, the method of calibrating the printing assembly 32 comprises aligning a first reference 52 associated with the printer 44 with a second reference 54 associated with the support 46, transporting an item 38 on the transport path P, and printing a pattern 66A, 66B on the item 38 using a first printing element 56A and a second printing element 56B. In an embodiment, aligning the first reference 52 associated with the printer 44 with the second reference 54 associated with the support 46 comprises aligning a zero graduation of the vernier scale with a zero graduation of the main scale. Further, the first printing element 56A is disposed at an extreme upstream position and the second printing element 56B is disposed at an extreme downstream position with respect to the transport path P.

In one example, the method comprises first rotating the mounting plate 48 such that the vernier scale and the main scale line up at the zero graduations. Then a blank piece of paper, such as a mailpiece, for example, is introduced onto the vacuum belt transport that is in motion in the transport path direction. When the paper translates under the print heads, only the most upstream and most downstream print heads print to create the test pattern 66A, 66B. In the illustrated embodiment, these are K and Y print heads. Due to the large spacing between them, those print heads provide the greatest magnification of rotational error about the Z-axis.

The method further comprises determining a correction value from the pattern 66A, 66B, and rotating the printer 44 relative to the support 46 in an amount corresponding to the correction value to substantially align the printing elements 56 with the transport path P.

In one embodiment, printing the pattern 66A, 66B on the item 38 comprises printing a plurality of lines substantially parallel to the transport path P using the first printing element 56A and the second printing element 56B. The first printing element 56A prints the lines using nozzles having a first lateral spacing and the second printing element 56B prints the lines using nozzles having a second lateral spacing different from the first lateral spacing. As discussed above, in one embodiment, the pattern is printed using print heads at an extreme upstream position and an extreme downstream position with respect to the transport path, corresponding to the K (black) and Y (yellow) print heads, respectively, in the illustrated embodiment.

Figure 4:
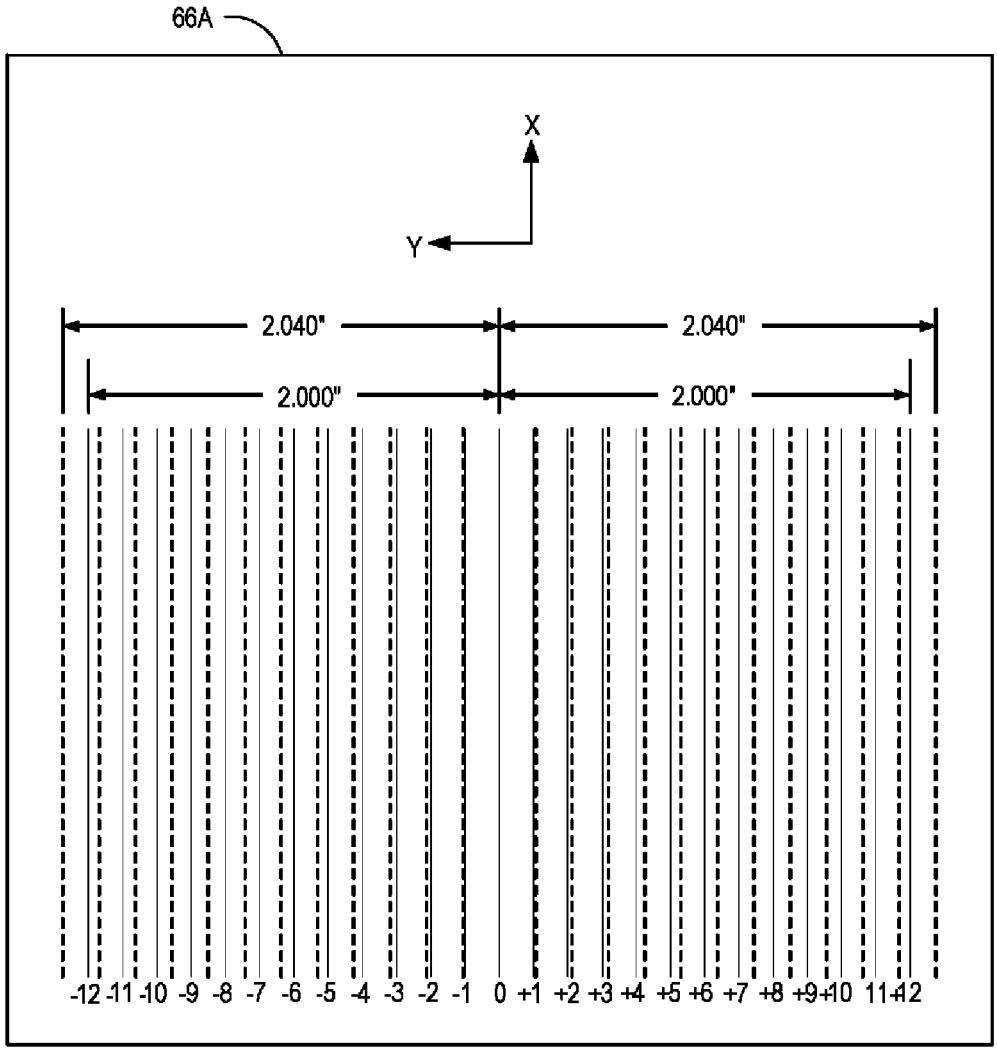
FIG. 4 is an embodiment of a test pattern associated with calibration of the printing assembly.

An example of a pattern 66A is shown in FIG. 4, in which the lines printed by the K print head are solid lines and the lines printed by the Y print head are dashed lines. The pattern 66A shown in FIG. 4 corresponds to a properly aligned system (i.e., where no adjustment is necessary), in which the K lines and Y lines fall directly on top of one another at the zero location. Because the two sets of lines have a different lateral spacing, the gaps between pairs of K lines and Y lines increase in each direction moving away from the zero location.

In one embodiment, the difference between the first lateral spacing and the second lateral spacing is a multiple of a print resolution of the printing elements. Thus, the distances between corresponding K lines and Y lines comprise multiples of the print resolution in the lateral direction (Y-direction as viewed in FIG. 3) with respect to the transport path P. Using this arrangement, no round-off error is introduced by printing lines that are not directly in line with the print nozzles.

In one example, the print resolution of the print heads 56 in the Y-direction is 300 dots per inch (dpi), which corresponds to 3.333-mil increments. On the test pattern shown in FIG. 4, for lines +1 or −1, the distance between corresponding K lines and Y lines is 3.333 mils. For lines +2 or −2, the distance between corresponding K lines and Y lines is two times 3.333 mils or 6.666 mils. This relationship pattern is carried out to +12 and −12, where the distance between corresponding K lines and Y lines is 40.000 mils.

According to a further embodiment of the method, each of the plurality of lines printed by the first printing element 56A and the second printing element 56B corresponds to a graduation on the vernier scale. As discussed above, in the illustrated embodiment, a vernier scale having +/−12 units was used, corresponding to a rotation angle about the Z-axis of approximately +/−0.40 degrees off of nominal. Thus, each of the plurality of K lines and Y lines correspond to one of the +/−12 vernier scale units.

Figure 6:
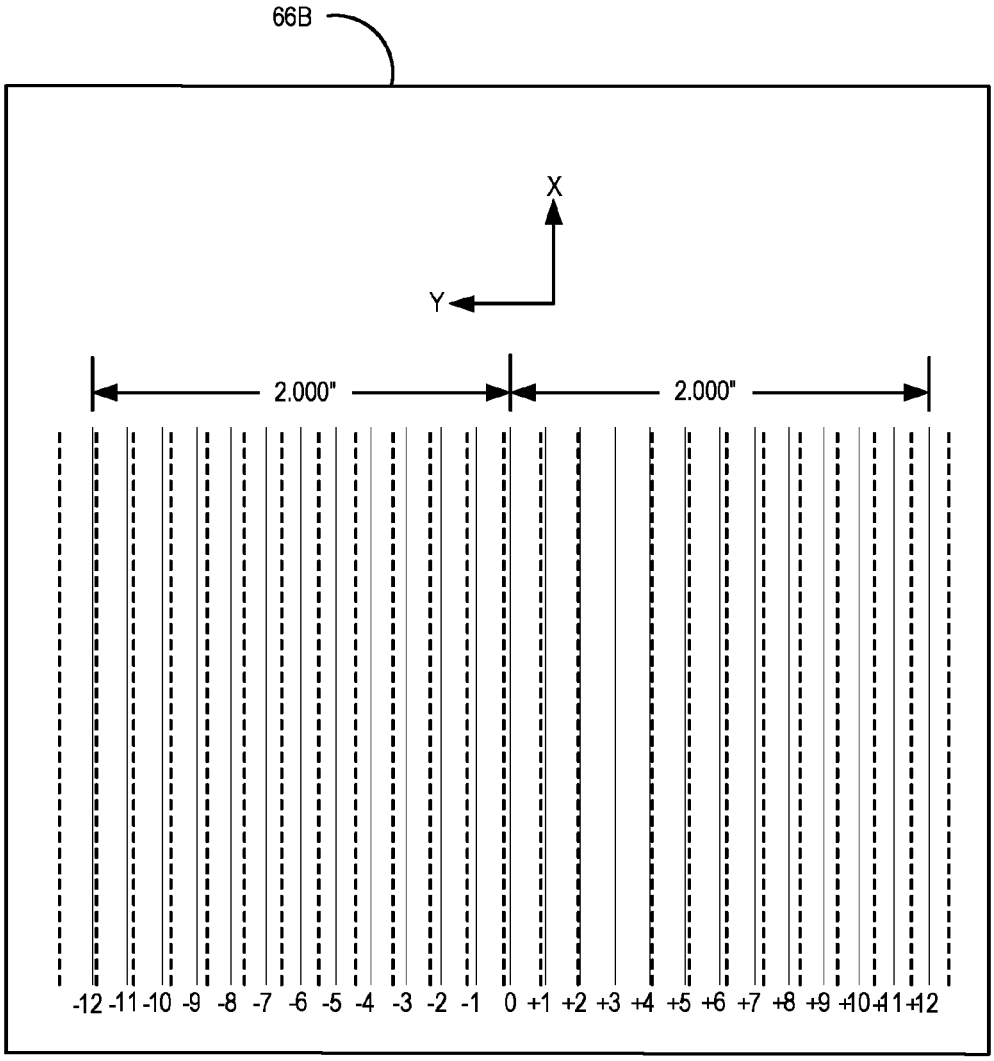
FIG. 6 is another embodiment of a test pattern associated with calibration of the printing assembly.

Further, according to this embodiment, determining the correction value from the pattern 66A, 66B comprises identifying a vernier graduation at which a line printed by the first printing element 56A substantially overlaps a line printed by the second printing element 56B. As discussed above, in FIG. 4, the K line and the Y line overlap at the zero vernier graduation, indicating that the correction value is zero. FIG. 6 illustrates a different pattern 66B in which the K line and the Y line overlap at the +3 vernier graduation, indicating a correction value in that case of +3.

In an embodiment of the method, rotating the printer 44 relative to the support 46 in an amount corresponding to the correction value comprises aligning the identified vernier graduation on the vernier scale with a corresponding graduation on the main scale. The rotation of the printer 44 may be made using a screw mechanism (not shown), for example, or other positioning device. Thus, for the case illustrated in FIG. 6, to substantially align the printing elements 56 with the transport path P, the +3 vernier graduation should be aligned with the +3 graduation on the main scale.

In another embodiment, determining the correction value comprises scanning the pattern 66A, 66B and processing the scanned pattern using a processing device 62 to identify the vernier graduation. With reference to FIG. 2, according to this embodiment, after the pattern 66A, 66B is printed on the item 38, the pattern is scanned by a scanner 64 as the item leaves the printing assembly 32 on the transport system 36. The processing device 62 processes the scanned pattern 66A, 66B using image recognition software, for example, and identifies the vernier graduation.

Further, according to this embodiment, rotating the printer 44 comprises receiving a signal in a controller 58 indicating the identified vernier graduation, and sending a signal to an actuator 60 to rotate the printer 44 to align the identified vernier graduation on the vernier scale with a corresponding graduation on the main scale. Thus, the processing device 62, after identifying the vernier graduation, sends a signal to the controller 58 indicating the value. The controller 58, in turn, sends a signal to the actuator 60 to rotate the printer 44 to align the identified vernier graduation on the vernier scale with the corresponding graduation on the main scale to substantially align the printing elements 56 with the transport path P.

According to the method of the invention, the proper adjustment value for the printing assembly may be obtained from a single test pattern without using a trial and error procedure.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A method of calibrating a printing assembly, comprising a transport system configured to transport items on a transport path and a printer rotatably disposed on a support, the printer comprising a plurality of printing elements disposed sequentially along the transport path, the method comprising:

aligning a first reference associated with the printer with a second reference associated with the support;

transporting an item on the transport path;

printing a pattern on the item using a first printing element and a second printing element;

determining a correction value from the pattern; and rotating the printer relative to the support in an amount corresponding to the correction value to substantially align the printing elements with the transport path, wherein the first reference comprises one of a main scale and a vernier scale and the second reference comprises the other of the main scale and the vernier scale.

2. The method of claim 1, wherein aligning the first reference associated with the printer with the second reference associated with the support comprises aligning a zero graduation of the vernier scale with a zero graduation of the main scale.

3. The method of claim 1, wherein the printing elements comprise inkjet print heads and, wherein printing the pattern on the item comprises printing a plurality of lines substantially parallel to the transport path using the first printing element and the second printing element.

4. The method of claim 3, wherein the first printing element prints the lines using nozzles having a first lateral spacing and the second printing element prints the lines using nozzles having a second lateral spacing different from the first lateral spacing.

5. The method of claim 4, wherein the difference between the first lateral spacing and the second lateral spacing is a multiple of a print resolution of the printing elements.

6. The method of claim 4, wherein each of the plurality of lines printed by the first printing element and the second printing element corresponds to a graduation on the vernier scale.

7. The method of claim 6, wherein determining the correction value from the pattern comprises identifying a vernier graduation at which a line printed by the first printing element substantially overlaps a line printed by the second printing element.

8. The method of claim 7, wherein rotating the printer relative to the support in an amount corresponding to the correction value comprises aligning the identified vernier graduation on the vernier scale with a corresponding graduation on the main scale.

9. The method of claim 7, wherein determining the correction value comprises:

scanning the pattern; and processing the scanned pattern using a processing device to identify the vernier graduation.

10. The method of claim 9, wherein rotating the printer comprises:

receiving a signal in a controller indicating the identified vernier graduation; and sending a signal to an actuator to rotate the printer to align the identified vernier graduation on the vernier scale with a corresponding graduation on the main scale.

11. The method of claim 1, wherein the first printing element is disposed at an extreme upstream position and the second printing element is disposed at an extreme downstream position with respect to the transport path.

12. A printing assembly, comprising a transport system configured to transport items on a transport path;

a printer rotatably disposed on a support, the printer comprising a plurality of printing elements disposed sequentially along the transport path; and a controller configured to:

control an actuator to rotate the printer to align a first reference associated with the printer with a second reference associated with the support, wherein the first reference comprises one of a main scale and a vernier scale and the second reference comprises the other of the main scale and the vernier scale;

control the transport system to transport an item on the transport path;

control the printer to print a pattern on the item using a first printing element and a second printing element;

control a scanner to scan the pattern and send the pattern to a processing device for determination of a correction value from the pattern; and control the actuator to rotate the printer relative to the support in an amount corresponding to the correction value to substantially align the printing elements with the transport path.

13. The assembly of claim 12, wherein the printing elements comprise inkjet print heads and, wherein the pattern on the item comprises a plurality of lines printed substantially parallel to the transport path using the first printing element and the second printing element.

14. The assembly of claim 13, wherein the first printing element prints the lines using nozzles having a first lateral spacing and the second printing element prints the lines using nozzles having a second lateral spacing different from the first lateral spacing.

15. The assembly of claim 14, wherein the difference between the first lateral spacing and the second lateral spacing is a multiple of a print resolution of the printing elements.

16. The assembly of claim 14, wherein each of the plurality of lines printed by the first printing element and the second printing element corresponds to a graduation on the vernier scale.

17. The assembly of claim 16, wherein the processing device determines the correction value from the pattern by identifying a vernier graduation at which a line printed by the first printing element substantially overlaps a line printed by the second printing element.

18. The assembly of claim 17, wherein the actuator is controlled to rotate the printer relative to the support in an amount corresponding to the correction value by aligning the identified vernier graduation on the vernier scale with a corresponding graduation on the main scale.

19. The assembly of claim 12, wherein the first printing element is disposed at an extreme upstream position and the second printing element is disposed at an extreme downstream position with respect to the transport path.

* * * * *